US006264147B1

(12) United States Patent
Mitchell

(10) Patent No.: US 6,264,147 B1
(45) Date of Patent: Jul. 24, 2001

(54) ELONGATE HANDLE HOLDER

(76) Inventor: Kevin S. Mitchell, No 1 Southend Farm Cottage Southend Common Henley-on-Thames, Oxfordshire RG9 6JR (GB)

( * ) Notice: Subject to any disclaimer, the term of this patent is extended or adjusted under 35 U.S.C. 154(b) by 0 days.

(21) Appl. No.: 09/314,918

(22) Filed: May 20, 1999

(51) Int. Cl.[7] ..... A46B 17/02

(52) U.S. Cl. ..... 248/111; 248/312; 248/316.1; 248/316.4; 248/113; 211/66; 211/89.01

(58) Field of Search ..... 248/111, 312, 248/316.1, 316.4, 113; 211/66, 70.6, 89.01

(56) References Cited

U.S. PATENT DOCUMENTS 116,140 * 6/1871 Beardsley ..... 248/316.4 X
350,523 * 10/1886 Bodley ..... 211/66 X
661,677 * 11/1900 Taylor ..... 248/316.4 X
1,246,492 * 11/1917 Thiele ..... 248/316.4 X
1,398,127 * 11/1921 Collins ..... 211/66 X
1,404,477 * 1/1922 Pattberg et al. ..... 211/66 X
1,864,817 * 6/1932 Hart ..... 248/113 X
4,121,798 * 10/1978 Schumacher et al. ..... 248/113
4,909,467 * 3/1990 Shan-Pao ..... 248/312
5,116,003 * 5/1992 Gerhardt ..... 248/312
5,165,629 * 11/1992 Breveglieri ..... 248/110

* cited by examiner

*Primary Examiner*—Leslie A. Braun
*Assistant Examiner*—A. Joseph Wujciak

(57) ABSTRACT

A elongate handle holder for holding an elongate handle of a broom, a mop, a tool, or the like therein. The elongate handle holder includes a block has front and back faces and an elongate slot extending therethrough between the front and back faces of the block. A holding member has a rear extent outwardly extending therefrom into the slot. The rear extent is pivotally coupled to block in the slot of the block. The holding member also has a bore extending therethrough between the top and bottom faces of the bore adapted for extending an elongate handle therethrough.

1 Claim, 2 Drawing Sheets

ELONGATE HANDLE HOLDER

BACKGROUND OF THE INVENTION

1. Field of the Invention

The present invention relates to tool, mop, and broom and the like handle holders and more particularly pertains to a new elongate handle holder for holding an elongate handle of a broom, a mop, a tool, or the like therein.

2. Description of the Prior Art

The use of tool, mop, and broom and the like handle holders is known in the prior art. More specifically, tool, mop, and broom and the like handle holders heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. Des. 301,976; U.S. Pat. No. 4,905,951; U.S. Pat. No. 2,488,664; U.S. Pat. No. 1,485,092; U.S. Pat. No. 5,303,831; and U.S. Pat. No. 3,294,350.

While these devices fulfill their respective, particular objectives and requirements, the aforementioned patents do not disclose a new elongate handle holder. The inventive device includes a block has front and back faces and an elongate slot extending therethrough between the front and back faces of the block. A holding member has a rear extent outwardly extending therefrom into the slot. The rear extent is pivotally coupled to block in the slot of the block. The holding member also has a bore extending therethrough between the top and bottom faces of the bore adapted for extending an elongate handle therethrough.

In these respects, the elongate handle holder according to the present invention substantially departs from the conventional concepts and designs of the prior art, and in so doing provides an apparatus primarily developed for the purpose of holding an elongate handle of a broom, a mop, a tool, or the like therein.

SUMMARY OF THE INVENTION

In view of the foregoing disadvantages inherent in the known types of tool, mop, and broom and the like handle holders now present in the prior art, the present invention provides a new elongate handle holder construction wherein the same can be utilized for holding an elongate handle of a broom, a mop, a toll, or the like therein.

The general purpose of the present invention, which will be described subsequently in greater detail, is to provide a new elongate handle holder apparatus and method which has many of the advantages of the tool, mop, and broom and the like handle holders mentioned heretofore and many novel features that result in a new elongate handle holder which is not anticipated, rendered obvious, suggested, or even implied by any of the prior art tool, mop, and broom and the like handle holders, either alone or in any combination thereof.

To attain this, the present invention generally comprises a block has front and back faces and an elongate slot extending therethrough between the front and back faces of the block. A holding member has a rear extent outwardly extending therefrom into the slot. The rear extent is pivotally coupled to block in the slot of the block. The holding member also has a bore extending therethrough between the top and bottom faces of the bore adapted for extending an elongate handle therethrough.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new elongate handle holder apparatus and method which has many of the advantages of the tool, mop, and broom and the like handle holders mentioned heretofore and many novel features that result in a new elongate handle holder which is not anticipated, rendered obvious, suggested, or even implied by any of the prior art tool, mop, and broom and the like handle holders, either alone or in any combination thereof.

It is another object of the present invention to provide a new elongate handle holder which may be easily and efficiently manufactured and marketed.

It is a further object of the present invention to provide a new elongate handle holder which is of a durable and reliable construction.

An even further object of the present invention is to provide a new elongate handle holder which is susceptible of a low cost of manufacture with regard to both materials and labor, and which accordingly is then susceptible of low prices of sale to the consuming public, thereby making such elongate handle holder economically available to the buying public.

Still yet another object of the present invention is to provide a new elongate handle holder which provides in the apparatuses and methods of the prior art some of the advantages thereof, while simultaneously overcoming some of the disadvantages normally associated therewith.

Still another object of the present invention is to provide a new elongate handle holder for holding an elongate handle of a broom, a mop, a tool, or the like therein.

Yet another object of the present invention is to provide a new elongate handle holder which includes a block has front and back faces and an elongate slot extending therethrough between the front and back faces of the block. A holding member has a rear extent outwardly extending therefrom into the slot. The rear extent is pivotally coupled to block in the slot of the block. The holding member also has a bore extending therethrough between the top and bottom faces of the bore adapted for extending an elongate handle therethrough.

Still yet another object of the present invention is to provide a new elongate handle holder that pivots downwards by the weight of the elongate handle being extended therethrough so that the elongate handle engages opposite sides of the bore to hold the elongate handle in plate in the holder.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
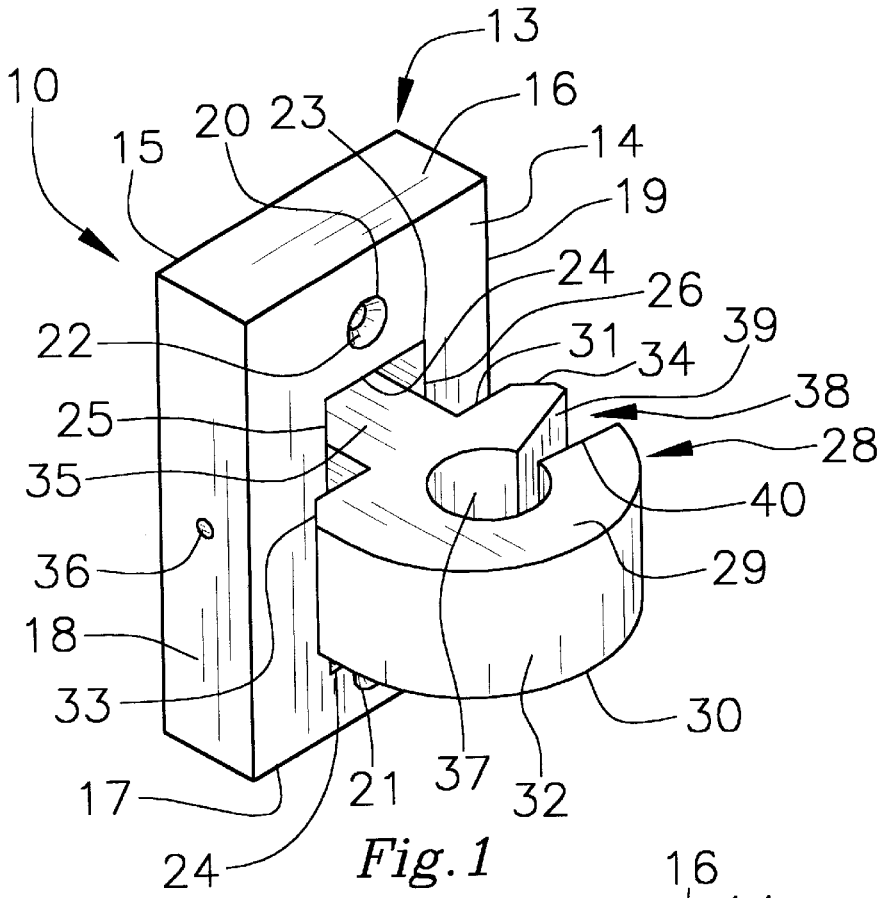
FIG. 1 is a schematic front perspective view of a new elongate handle holder according to the present invention.
Figure 2:
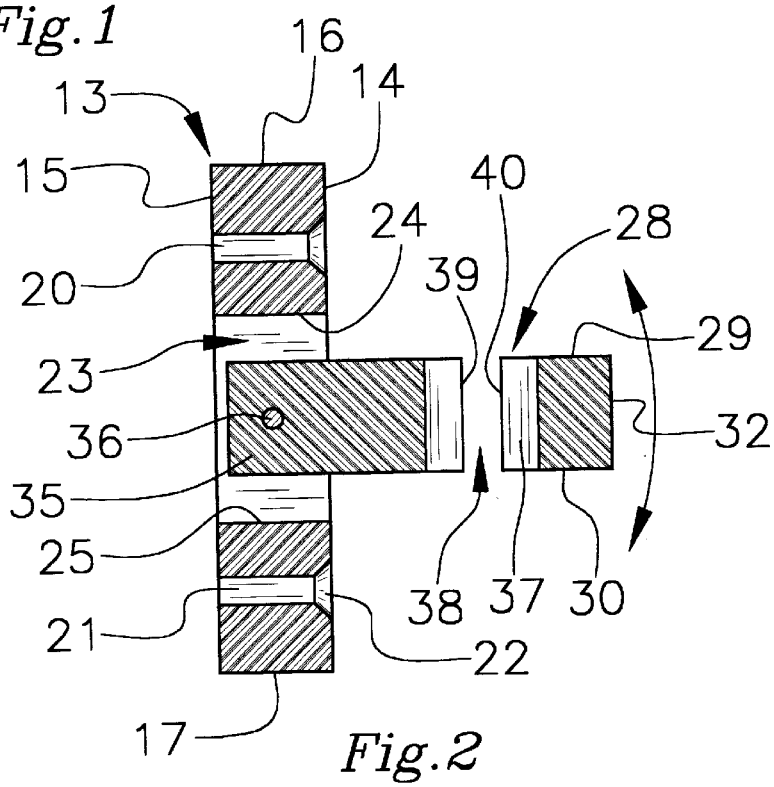
FIG. 2 is a schematic cross sectional view of the present invention.
Figure 3:
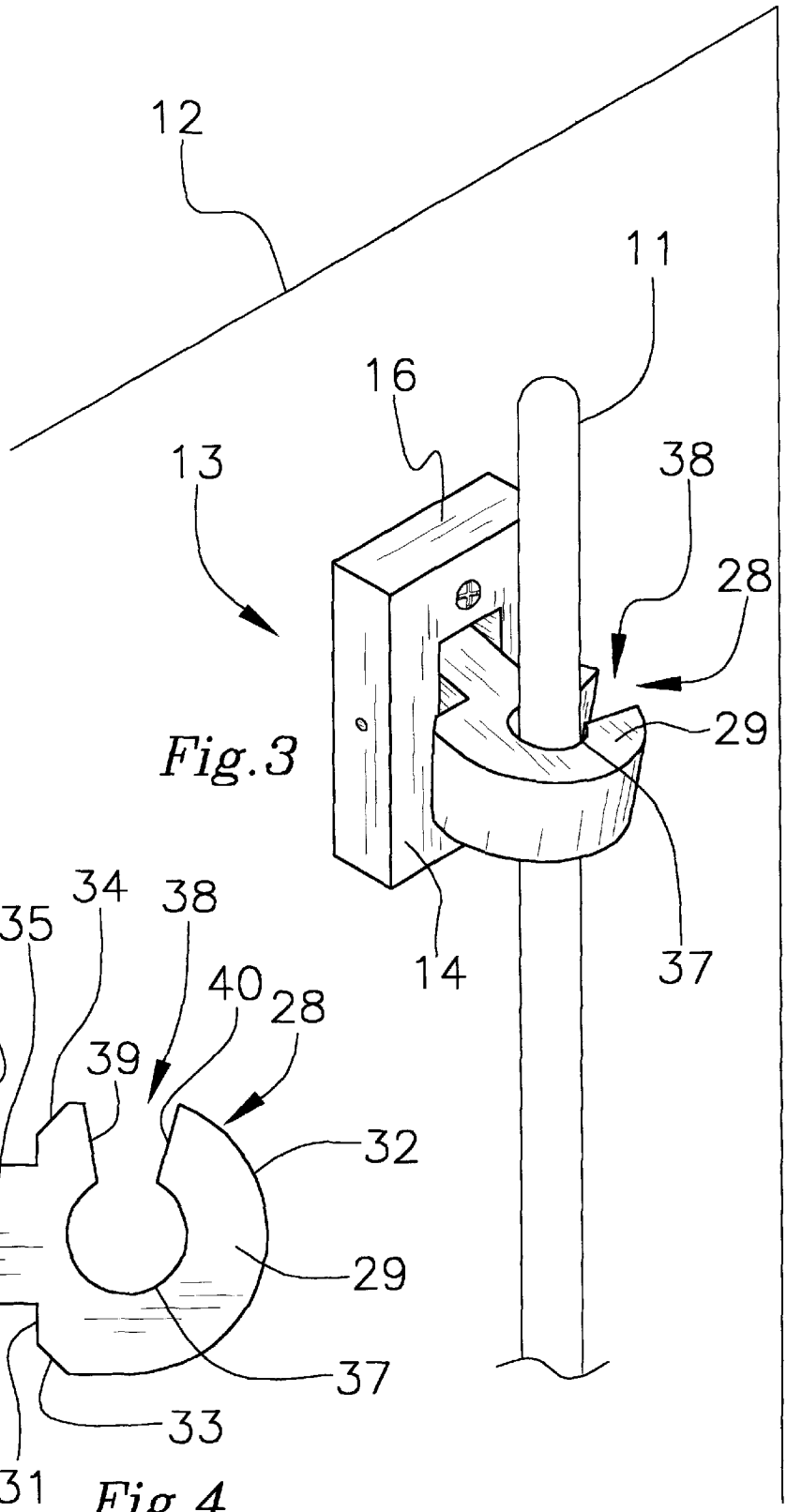
FIG. 3 is a schematic front perspective view of the present invention in use.
Figure 4:
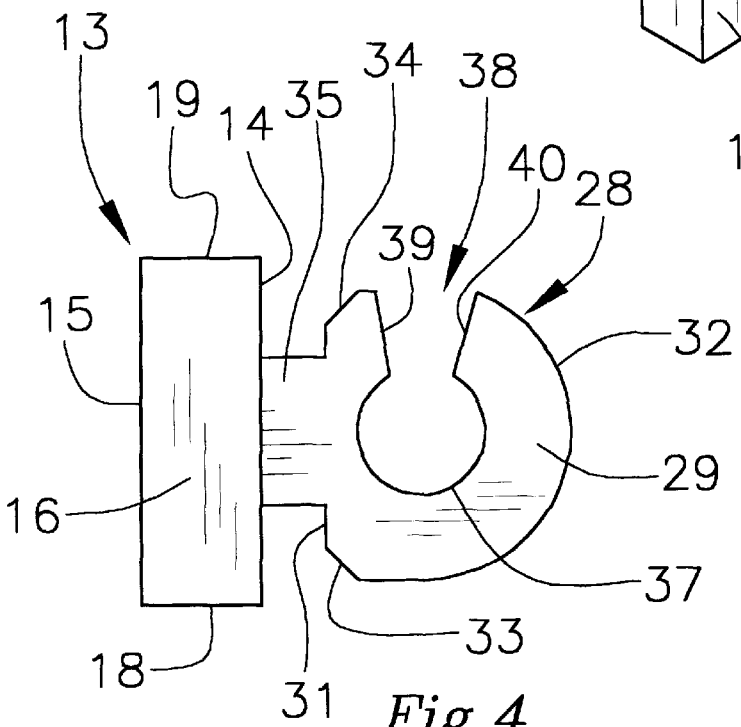
FIG. 4 is a schematic top plan view of the present invention.

With reference now to the drawings, and in particular to FIGS. 1 through 4 thereof, a new elongate handle holder embodying the principles and concepts of the present invention and generally designated by the reference numeral 10 will be described.

As best illustrated in FIGS. 1 through 4, the elongate handle holder 10 generally comprises a block has front and back faces and an elongate slot extending therethrough between the front and back faces of the block. A holding member has a rear extent outwardly extending therefrom into the slot. The rear extent is pivotally coupled to block in the slot of the block. The holding member also has a bore extending therethrough between the top and bottom faces of the bore adapted for extending an elongate handle therethrough.

In use, the handle holder 10 is designed for holding the elongate handle 11 of a broom, a mop, a tool and similar articles to a structure such as a wall structure 12. In closer detail, the handle holder comprises a generally rectangular block 13 having substantially parallel generally rectangular front and back faces 14,15, substantially parallel top and bottom edges 16,17 and a pair of substantially parallel side edges 18,19 extending substantially perpendicular to the top and bottom edges of the block. The top, bottom and side edges of the block lie in a planes substantially perpendicular to the front and back faces of the block. In an ideal illustrative embodiment, the block has a length defined between the top and bottom edges of about 11 cm and a width defined between the side edges of the block of about 7 cm.

In use, the block is designed for mounting to a vertical support structure such as a wall structure such that the back face of the block faces the structure. The block has a spaced apart pair of mounting holes 20,21 therethrough extending between the front and back faces of the block. Each of the mounting holes is designed for extending a fastener therethrough and into the support structure to secure the block to the support structure. One of the mounting holes of the block is positioned towards the top edge of the block. The other of the mounting holes is positioned towards the bottom edge of the block. Preferably, the mounting holes are generally equidistantly positioned between the side edges of the block. Ideally, each of the mounting holes has an annular counter sink 22 adjacent the front face of the block designed for receiving the head of the fastener therein.

The block has an elongate slot 23 extending therethrough between the front and back faces of the block. The slot of the block is positioned between the mounting holes of the block and preferably generally equidistantly between the side edges of the block. The slot of the block has a generally rectangular outer periphery comprising substantially parallel top and bottom ends 24,25 and a pair of substantially parallel sides 26,28 extending substantially perpendicular to the top and bottom ends of the slot. The top and bottom ends of the slot are extended substantially parallel to the top and bottom edges of the block and the sides of the slot are extended substantially parallel to the side edges of the block.

A holding member 28 is also included having substantially parallel planar top and bottom faces 29,30 and a generally D-shaped outer perimeter comprising a substantially straight back edge 31, and an arcuate front edge 32 defining an arc formed has an angle of curvature of at least about 180 degrees. Preferably, the outer perimeter of the holding member further comprises a spaced apart pair of beveled corners 33,34 formed at unions between the front and back edges of the holding member. The beveled corners of the holding member are extended at an acute angle to the back edge of the holding member.

The holding member has a generally rectangular rear extent 35 outwardly extending from back edge of the holding member. The rear extent is preferably located equidistantly between the beveled corners of the holding member. The rear extent has substantially parallel generally rectangular top and bottom faces, a generally rectangular back face opposite said holding member, and a pair of substantially parallel side faces extending substantially perpendicular to the top and bottom faces of the rear extent. The top faces of the rear extent and the holding member are substantially coplanar with one another and the bottom faces of the rear extent and the holding member are substantially coplanar with one another.

The rear extent is inserted into the slot of the block such that the holding member outwardly extends from the front face of the block and the back face of the rear extent faces in an towards the back face of the block. The sides of the rear extent are pivotally coupled to the sides of the slot of the block to permit pivoting of the rear extent and the holding member about a pivot axis extending perpendicular to the sides of the slot which is horizontally extended when the block is mounted to the support structure so that holding member may be pivoted up and down with respect to the front face of the block. Preferably, a generally cylindrical elongate pivot pin 36 is extended through the block, through the sides of the slot into the slot of the block, and through sides of the rear extent to pivotally couple the sides of the rear extent to the sides of the slot. The pivot pin has a pair of opposite ends. One of the ends of the pivot pin lie flush or is coplanar with one of the side edges of the block and the other of the ends of the pivot pin lie flush or is coplanar with the other of the side edges of the block.

The holding member has a generally cylindrical bore 37 extending therethrough between the top and bottom faces of the bore. In use, the bore of the holding member is designed for extending an elongate handle of a broom or similar article therethrough upwardly into the bore via the bottom face of the holding member and up out of the bore via the top face of the holding member. In use, pivoting downwards of the holder member causes the elongate handle to be skewed in the bore so that the elongate handle and bore are not coaxial so that a portion of the elongate handle abuts an portion of the bore adjacent the top face of the holding member and an lower opposite portion of the elongate handle abuts an opposite portion of the bore adjacent the bottom face of the holding member. The weight of the elongate handle helps these abutments hold the elongate handle to the holding member in the bore.

The holding member may preferably have a generally trapezoidal break 38 therethrough extending between the bore and the arcuate front edge of the holding member to provide a passage into the bore from the arcuate front edge of the holding member. The holding member comprises a resilient material such that the break of the holding member forming a pair of resiliently deflectable arms having opposing ends 39,40. The ends of the arms lie in planes forming an acute angle therebetween with the planes of the ends of the arms converging towards one another in a direction from the arcuate front edge of the holding member to the bore of the holding member. In use, the break is designed for permitting the bore of the holding member to receive elongate handles has outer diameters greater than the diameter of the bore of the holding member.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A handle holder, comprising:

a generally rectangular block having substantially parallel generally rectangular front and back faces, substantially parallel top and bottom edges and a pair of substantially parallel side edges extending substantially perpendicular to said top and bottom edges of said block;

said top, bottom and side edges of said block lying in planes substantially perpendicular to said front and back faces of said block;

wherein said block has a length defined between said top and bottom edges of about 11 cm and a width defined between said edges of said block of about 7 cm;

said block being adapted for mounting to a vertical support structure;

said block having a spaced apart pair of mounting holes therethrough extending between said front and back faces of said block;

each of said mounting holes being adapted for extending a fastener therethrough and into the vertical support structure to secure said block to the support structure;

one of said mounting holes of said block being positioned towards said top edge of said block, the other said mounting holes being positioned towards said bottom edge of said block;

said mounting holes being generally equidistantly positioned between said side edges of said block;

each of said mounting holes having an annular counter sink adjacent said front face of said block adapted for receiving the head of the fastener therein;

said block having an elongate slot extending therethrough between said front and back faces of said block;

said slot of said block being positioned between said mounting holes of said block and generally equidistantly between said side edges of said block;

said slot of said block having a generally rectangular outer periphery comprising substantially parallel top and bottom ends and a pair of substantially parallel sides extending substantially perpendicular to said top and bottom ends of said slot;

said top and bottom ends of said slot being extended substantially parallel to said top and bottom edges of said block, said sides of said slot being extended substantially parallel to side edges of said block;

a holding member having substantially parallel planar top and bottom faces and a generally D-shaped outer perimeter comprising a substantially straight back edge, and an arcuate front edge defining an arc formed having an angle of curvature of at least 180 degrees;

said outer perimeter of said holding member further comprising a spaced apart pair of beveled corners being formed at unions between said front and back edges of said holding member;

said beveled corners of said holding member being extended at an acute angle to said back edge of said holding member;

said holding member having a generally rectangular rear extent outwardly extending from back edge of said holding member;

said rear extent being located equidistantly between said beveled corners of said holding member;

said rear extent having substantially parallel generally rectangular top and bottom faces, a generally rectangular back face, and a pair of substantially parallel side faces extending substantially perpendicular to said top and bottom faces of said rear extent;

said top faces of said rear extent and said holding member being substantially coplanar with one another and said bottom faces of said rear extent and said holding member being substantially coplanar with one another;

said rear extent being inserted into said slot of said block such that said holding member outwardly extends from said front face of said block;

said sides of said rear extent being pivotally coupled to said side edges of said holding member about a pivot axis extending perpendicular to said sides of said slot which is horizontally extended when said block is mounted to the support structure such that said holding member may be pivoted up and down with respect to said front face of said block;

wherein a pivot pin is extended through said block, through side edges of said slot into said slot of said block, and through sides of said rear extent to pivotally couple said sides of said rear extent to said sides of said slot;

said pivot pin having a pair of opposite ends, one of said ends of said pivot pin being coplanar with one of said side edges of said block, the other of said ends of said pivot pin being coplanar with the other of said side edges of said block;

said holding member having a generally cylindrical bore extending therethrough between said top and bottom faces of said bore;

said bore of said holding member being adapted for extending an elongate handle of a broom or similar article therethrough upwardly into said bore via said bottom face of said holding member and up out of said bore via said top face of said holding member;

wherein pivoting downwards of said holding member causes the elongate handle to be skewed in said bore such that the elongate handle and said bore are not coaxial such that a portion of the elongate handle abuts a portion of said bore adjacent said top face of said holding member and a lower opposite portion of the elongate handle an opposite portion of said bore adjacent said bottom face of said holding member;

said holding member having a generally trapezoidal break therethrough extending between said bore and said arcuate front edge of said holding member to provide a passage into said bore from said arcuate front edge of said holding member;

said break of said holding member forming a pair of arms having opposing ends, said ends of said arms lying in planes forming an acute angle therebetween, said planes of said ends of said arms converging towards one another in a direction from said arcuate front edge of said holding member to said bore of said holding member; and wherein said block has a thickness defined between said front and back faces, said holding member having a thickness defined between said top and bottom faces such that said thickness of said block is equal to said thickness of said holding member for facilitating support of said holding member by said block.

* * * * *